United States Patent [19]

Doré et al.

[11] Patent Number: 4,660,494

[45] Date of Patent: Apr. 28, 1987

[54] MOORING DEVICE

[75] Inventors: Bernard-Frederic Doré, Roquebrune; Daniel J. Gastowt, Nice, both of France

[73] Assignee: Single Buoy Moorings Inc., Marly, Switzerland

[21] Appl. No.: 841,664

[22] Filed: Mar. 19, 1986

Related U.S. Application Data

[63] Continuation of Ser. No. 654,093, Sep. 24, 1984, abandoned.

[30] Foreign Application Priority Data

Sep. 23, 1983 [NL] Netherlands ..... 8303279

[51] Int. Cl.[4] ..... B63B 21/52

[52] U.S. Cl. ..... 114/230

[58] Field of Search ..... 114/230, 264; 441/3-5; 175/5, 7; 141/383

[56] References Cited

U.S. PATENT DOCUMENTS

| | | | |
|---|---|---|---|
| 3,590,407 | 7/1971 | Bratianu . | |
| 4,254,523 | 3/1981 | Kentosh | 114/230 X |
| 4,279,047 | 7/1981 | van Heijst . | |
| 4,305,341 | 12/1981 | Stafford | 114/230 |
| 4,490,121 | 12/1984 | Ceppens et al. | 114/230 X |

FOREIGN PATENT DOCUMENTS

| | | |
|---|---|---|
| 1257620 | 12/1967 | Fed. Rep. of Germany . |
| 8200358 | 8/1982 | Netherlands . |
| 2046199 | 11/1980 | United Kingdom . |

*Primary Examiner*—Joseph F. Peters, Jr.
*Assistant Examiner*—Edwin L. Swinehart
*Attorney, Agent, or Firm*—Young & Thompson

[57] ABSTRACT

The invention is a mooring device comprising a ship with outwardly extending arms one above the other which arms carry a vertical casing which is rotatable about a vertical axis and below the lower arm has structure for fastening anchor lines, the casing being supported in the upper arm (4) by an axial radial bearing (11,12) above the water level and in the lower arm (3) by a radial bearing (10).

3 Claims, 1 Drawing Figure

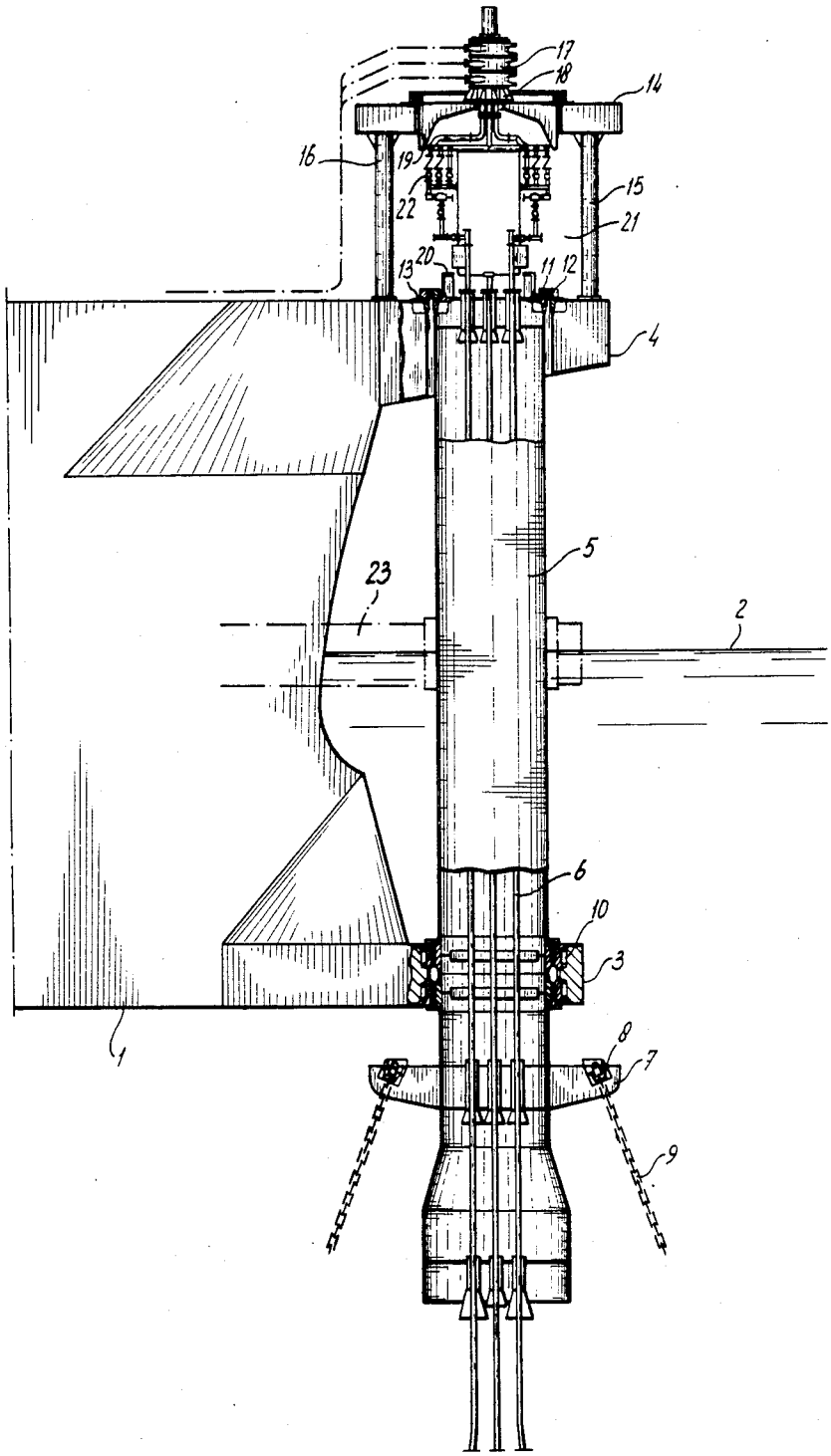
17
18
14
16
19
22
15
21
13
20
11
12
4
5
23
2
6
10
3
1
8
7
9

MOORING DEVICE

This application is a continuation of application Ser. No. 654,093, filed Sept. 24, 1984, now abandoned.

The invention relates to a mooring device consisting of a ship which at one end, such as the bow, is provided with arms projecting in the same direction and spaced apart one above the other, of which one is situated under water and the other above water, these arms carrying a vertical casing which is rotatable about a vertical axis and is supported in the lower arm by means of a radial bearing, this casing projecting under the lower arm and being provided there with means for fastening anchor lines, while at the top end the casing carries the stationary part of a pipe coupling from which pipes extend downwards through the casing.

An arrangement of this kind is known from U.S. Pat. No. 4,254,523. In this known arrangement the mounting for the casing, for example utilising a roller bearing, is entirely accommodated in the bottom arm, this bearing being able to take axial and radial forces and consisting of two bearings spaced apart, one disposed near the lower face of the lower arm and one near the upper face of the lower arm. The upper arm is in the form of a tube which is connected to the rotatable part of a pipe coupling.

The bearing construction in the lower arm is so designed that it can take all axial and radial loads which may occur in any weather conditions, because the forces acting on the ship are transmitted via these bearings to the anchor lines. The mounting on each of the parts of the rotatable pipe coupling at the top end of the casing plays no part, and moreover must not play any part therein.

This means that in the known mooring device the bearings are situated under water in a poorly accessible position, and so close to one another that a heavy bearing construction is necessary in order to be able to cope with the forces which occur.

This bearing arrangement is in the first place constantly loaded by the vertical forces originating from the anchorage, for example through the weight of the anchor chains. Radial loads occur only when the tanker undergoes displacement from the zero position. The radial bearings are then also loaded less frequently, and thus have a longer life.

The aim of the invention is to provide an improvement in this respect.

According to the invention this aim is achieved in that the casing is supported in the upper arm by an axial-radial bearing. According to the invention, the mounting is thus distributed over the two arms, which are situated at a distance from each other, and the bearing taking the axial forces is situated above water and therefore in an accessible position.

Through this distribution over the two arms and through the siting above water of the bearing taking the axial forces, a lighter construction permitting better maintenance and repair is possible.

A very expedient embodiment is one in which the axial-radial bearing consists of a roller bearing having an outer ring which is fastened on the top surface of the upper arm, and an inner ring which is fastened to the top end of the casing. Servicing or replacement of the bearing can then be carried out in a simple manner, because direct access is possible from the top surface of the upper arm. Through the positioning of the bearings in accordance with the invention, a strong upper arm construction is possible, so that the rotatable part of the pipe coupling can be placed on the upper arm by mounting on a platform which is supported on the upper arm, at some distance from the latter. A space is thus formed between the platform and the upper arm for the accommodation of pipes and valves. In addition, hoisting means can now be disposed on this upper arm for the handling of pipes or hoses by way of the casing.

The invention will now be further explained with reference to the drawing, which shows the apparatus according to the invention partly in elevation and partly in section.

The drawing shows the bow of a tanker 1, provided under the water with an arm 3 and, above the water level, with an arm 4.

The two arms 3, 4 have openings which lie in line and in which is rotatably mounted a casing 5 through which pipes 6 extend and which is provided with a circumferential table 7 with chain stoppers 8 for anchor chains 9. The casing 5 is mounted in the bottom arm 3 with the aid of a radial roller bearing 10.

The top end of the casing 5 is fastened to the inner ring 11 of an axial-radial roller or ball bearing, the outer ring 12 of which is fastened on the top face 13 of the arm 4.

A platform 14 is also mounted on the top face of the arm 4, for example with the aid of pillars 15, 16. On this platform is disposed the rotatable part 17 of a pipe coupling, the stationary part 18 of which bears against the casing 5 by way of a yoke 19 and of connections (not shown) to the top part 20 of the casing.

Between the platform 14 and the arm 4 there is thus created a space 21 for the accommodation of pipes with valves 22, as is customary in a so-called manifold chamber.

The axial-radial bearing 11, 12 is easily accessible and takes the axial, that is to say vertical forces originating from the anchorage. These forces are transmitted through the casing 5.

Instead of the double radial roller bearing 10 it is also possible to use a plain bearing. At the same time a construction accessible from within the casing 5 is conceivable. The casing 5 can be freed of water by forcing air into it.

In addition, it is also possible for one of the radial bearings to be disposed above the water level, for example when the bottom arm 3 lies very close to the water level, or if a third arm is fitted at the height of the water level, as indicated in broken lines at 23.

We claim:

1. Mooring device consisting of a ship which at one end is provided with arms projecting in the same direction and spaced apart one above the other, of which one is situated under water and the other above water, these arms carrying a vertical casing which is rotatable about a vertical axis and is supported in the lower arm by means of a bearing which bears substantially only a radial load, this casing projecting under the lower arm and being provided there with means for fastening anchor lines; a pipe coupling having a stationary part mounted on a top end of the casing, pipes extend downwardly from the pipe coupling through the casing, the casing being supported in the upper arm by a bearing that bears not only a radial load but also substantially all the axial load of the casing, the last-named bearing comprising a roller bearing having an outer ring that is secured on a top face of said upper arm and an inner ring that is secured on a top face of the casing, said upper arm surrounding the upper end of the casing, said inner ring and said outer ring being disposed outside and above all the space which is surrounded by said upper arm.

2. Mooring device as claimed in claim 1 characterised in that a third arm provided with a radial bearing for the casing is disposed between the upper arm and the lower arm.

3. Mooring device according to claim 1, characterised in that the coupling has a rotatable part, the rotatable part of the pipe coupling is disposed on a platform which is fastened on and spaced apart from the top arm, while a pipe and valve space is formed in the space between the platform and the upper arm.

* * * * *